US005953991A

United States Patent [19]

Geissenberger et al.

[11] Patent Number: 5,953,991

[45] Date of Patent: Sep. 21, 1999

[54] SWIVELABLE CYLINDER DRIVEN BY AN ELECTRIC INDIVIDUAL DRIVE

[75] Inventors: Stefan Geissenberger; Nils-Hendric Schall, both of Augsburg; Michael Schramm, Aindling-Gualzhofen; Bernhard Feller, Friedberg; Michael Hess, Mainz-Kastel; Michael Dotzert, Friedrichsdorf, all of Germany

[73] Assignee: MAN Roland Druckmaschinen AG, Offenbach am Main, Germany

[21] Appl. No.: 09/081,035

[22] Filed: May 18, 1998

[30] Foreign Application Priority Data

May 17, 1997 [DE] Germany ..... 197 20 952

[51] Int. Cl.[6] ..... B41F 13/24

[52] U.S. Cl. ..... 101/218; 101/247

[58] Field of Search ..... 101/216, 217, 101/218, 247, 248, 212, 219, 182

[56] References Cited

U.S. PATENT DOCUMENTS

| | | | |
|---|---|---|---|
| 5,492,062 | 2/1996 | Harris et al. | 101/247 |
| 5,570,633 | 11/1996 | Schultz et al. | 101/182 |
| 5,588,362 | 12/1996 | Sugiyama et al. | 101/218 |
| 5,649,482 | 7/1997 | Hummel et al. | 101/218 |
| 5,690,029 | 11/1997 | Hermann et al. | 101/218 |
| 5,704,288 | 1/1998 | John | 101/216 |
| 5,706,728 | 1/1998 | Motard et al. | 101/247 |

FOREIGN PATENT DOCUMENTS

| | | |
|---|---|---|
| 41 38 479 A1 | 6/1993 | Germany . |
| 196 24 394 | 12/1997 | Germany . |
| 196 24 394 C1 | 12/1997 | Germany . |
| 2 261 629 | 5/1993 | United Kingdom . |

*Primary Examiner*—Eugene Eickholt
*Attorney, Agent, or Firm*—Cohen, Pontani, Lieberman & Pavane

[57] ABSTRACT

A cylinder for a printing press is adjusted away from a printing stock web or an adjacent cylinder by rotation of an eccentric element. The change in position caused by the movement of the eccentric element is compensated by an additional rotating movement superposed on the rotating movement of the cylinder such that the outer surface of the cylinder has no relative velocity relative to the adjacent cylinder or the printing stock web. Compensation is carried out by a regulating circuit to which is supplied the actual rotational angle of the cylinder with respect to the eccentric element and the actual rotational angle of the eccentric element with respect to the side wall or an angular function derived therefrom.

11 Claims, 4 Drawing Sheets

$V_{WEB}$
110
$\omega_{CYL.} = \frac{V_{WEB}}{r_{CYL.}}$
115
$\varphi_{CYL.} = \int \omega_{CYL.} dt$
120
S1
+
-
$\varphi_{REF}$
S2
+
-
POSITION REGULATOR
125
$\omega_{REF}$ +
S3
-
$\omega_{1CYL.}$
SPEED REGULATOR
130
$I_{REF}$
M
135
G
140
Z
150
$\varphi_{1CYL.}$
$\frac{d\varphi_{1CYL.}}{dt}$
145
$\varphi_{1CYL.}$
$\varphi_{ECC.}$
148
$\varphi_{1CYL.}$

SWIVELABLE CYLINDER DRIVEN BY AN ELECTRIC INDIVIDUAL DRIVE

BACKGROUND OF THE INVENTION

1. Field of the Invention

The invention is directed to a cylinder in a printing machine, wherein the cylinder is driven by an electric individual drive and is arranged so as to be swivelable with respect to its position by means of a swiveling device, wherein a rotation transducer or rotation sensor is arranged at the cylinder for measuring its angular position with respect to the swiveling device.

2. Description of the Related Art

Recently, there has been an increase in the use of printing machines with individually driven cylinders such, for example, as an offset printing machine with both a form cylinder and a blanket cylinder having an individual electric drive motor. In the offset type of printing machine, the blanket cylinders must be adjusted or moved toward the printing stock web at the start of a printing process and adjusted or moved away from it at the end of the printing process. For this purpose, the blanket cylinders are arranged together with their electric drive arrangement on a swiveling device. The swiveling device is an eccentric element or a rocker type mechanism, for example. The plate cylinder, form cylinder, or other cylinders, such as a printing cylinder, may also be swivelably arranged. When an eccentric element is used, the eccentric element is rotatably mounted in a sidewall of the printing machine. The shaft of the cylinder is eccentrically mounted on the eccentric element with respect to the center of rotation of the eccentric element.

A prior art cylinder for a printing mechanism that is driven by an individual drive, is known from German reference DE 196 24 394 A1. In this prior art cylinder, a hollow neck or journal of the cylinder is received eccentrically on a spindle unit that is mounted, in turn, in a side wall of the printing mechanism. A carrying tube of the spindle unit houses a stator of an electric motor. A rotation sensor housing located on the journal is fastened to the carrying tube for regulating the driving of the motor. For purposes of changing the position of the cylinder relative to an adjacent cylinder, the spindle unit and, accordingly, the carrying tube are rotated. During rotation of the spindle unit, the stator of the motor and the rotation sensor housing are also rotated. Accordingly, the reference angle to which the rotation sensor references the rotational angle position of the journal of the cylinder, and therefore the rotational angle position of the rotor of the motor, is also displaced. This results in an unwanted rotation of the cylinder being moved in relation to the adjacent cylinder cooperating with it.

It has been shown in practice that even small displacement paths between the "print on" and "print off" positions of the cylinder lead to large rotations of the above described eccentric mechanism . For example, displacement paths of 0.1 mm already require 10-degree rotation of the eccentric mechanism. This problem also occurs when a rocker is used as a swiveling device for the cylinder. However, the angular errors occurring with rockers, depending on their length, are smaller than with eccentric mechanisms.

After a swiveling movement is carried out, the intended angular position of the cylinder is displaced not only in relation to the adjacent cylinder, but also in relation to the printing stock web. The movement in relation to the printing stock web occurs because, the blanket cylinder, due to the position regulation, also executes a further movement in addition to its movement corresponding to the web speed of the printing stock when the eccentric mechanism is rotated. The further movement comprises a rotating movement and—corresponding to the offset of the center of rotation of the cylinder from the center of the eccentric—a transverse movement. This movement can cause the printing stock web to tear during the print-on/print-off setting process because the blanket cylinder not only rolls along the surface of the printing stock web, but also causes sliding friction on its surface due to the translational movement. In this respect, the blanket cylinder draws the printing stock web toward it.

SUMMARY OF THE INVENTION

It is the object of the invention to correct the rotational movement of the cylinder that is corrupted by the swiveling movement of the eccentric mechanism or rocker type device and to prevent tearing of the printing stock web.

The object of the invention is met according to the invention with a swivelable cylinder assembly which includes a swivelable cylinder for a printing machine that is mounted on a swiveling device. The angular position of the cylinder with respect to the swiveling device and the swivel movement of the-swiveling device with respect to the printing machine in which it is located are measured by measuring devices. A reference rotational angle is obtained from an angular value of the web speed of the printing machine and the angle value of the swivel movement of the swiveling device. The reference rotational angle of the cylinder is compared to the measured rotational angle of the cylinder and a control signal is generated in response to the comparison for controlling the rotational velocity of the cylinder.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The invention will be described more fully in the following with reference to the drawings. In the drawings.

DETAILED DESCRIPTION OF THE PRESENTLY PREFERRED EMBODIMENTS

Figure 1:
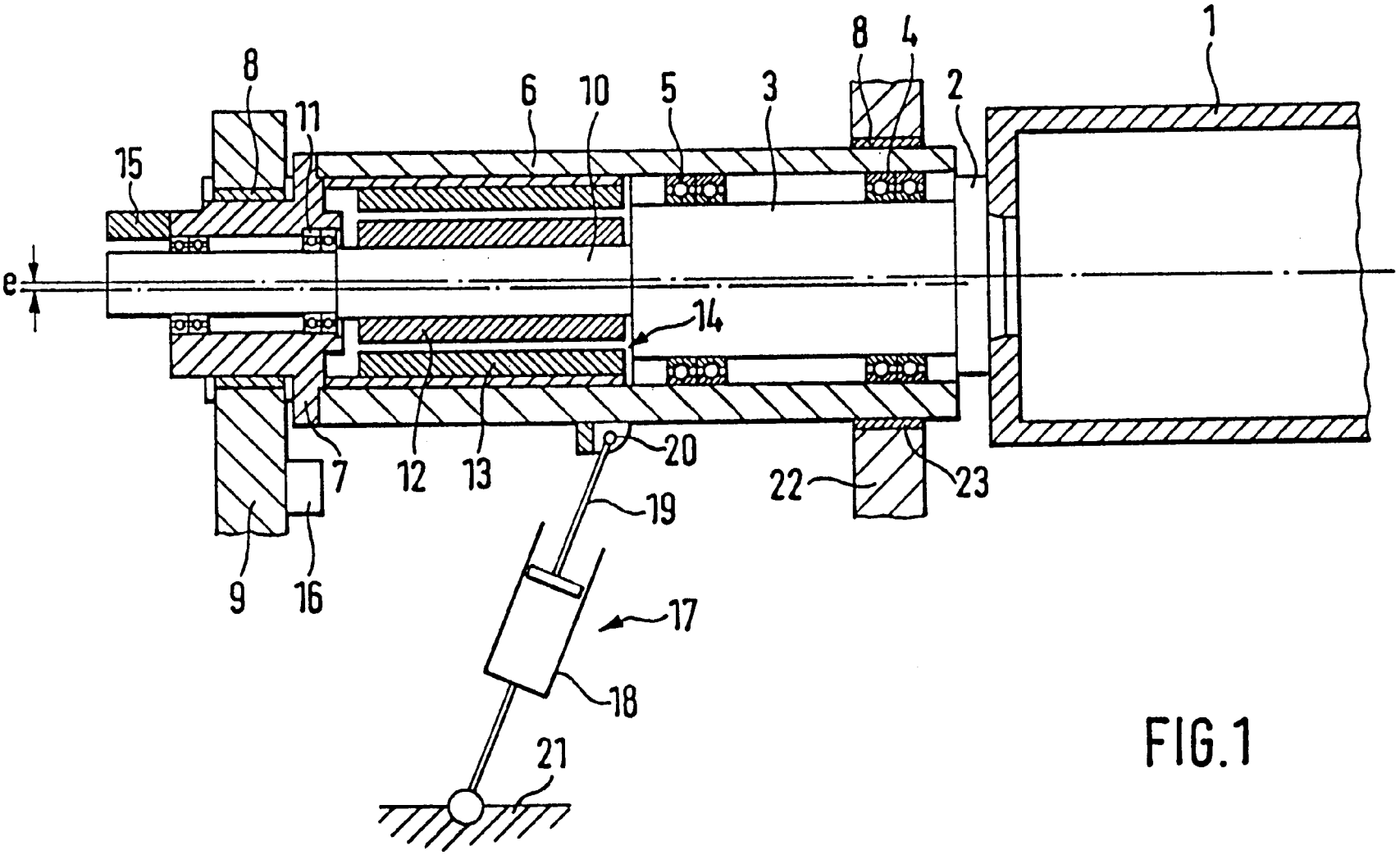
FIG. 1 is a sectional view of an eccentrically mounted blanket cylinder according to the present invention.

Referring initially to FIG. 1, a cylinder 1 such, for example, as a form cylinder or a blanket cylinder is rotatably mounted in a carrying tube 6 by its shaft journal 2 and a shaft 3 by roller bearings 4, 5. The carrying tube 6 is fixedly connected with an eccentric element 7 on a side remote from the cylinder 1 and is formed eccentrically, with respect to the shaft 3. The eccentric element 7 is rotatably mounted in a side wall 9 via needle bearings 8 or any other suitable bearings. A connection tube 10 is flange mounted on the shaft 3 and is rotatably mounted via ball bearings 11 in the eccentric element 7. In the region between the ball bearings 11 and the end side of the shaft 3, the connection tube 10 is surrounded by a rotor 12 of an electric motor 14. A stator winding 13 of the electric motor is fastened to the inner side of the carrying tube 6. The rotor 12 and the stator 13 are separated from one another by an air gap as in any electric motor. The electric motor 14 rotates the connection tube 10, shaft 3, and cylinder 1 relative to the carrying tube 6 and the eccentric element 7. A rotation sensor 15 is mounted on the eccentric element 7 on the side of the side wall 9 remote from the cylinder 1 on a projection of the eccentric 7, but could be located anywhere along the shaft 3. The rotation sensor 15 measures the rotational angle of the cylinder 1 at the connection tube 10 relative to the eccentric element 7 with respect to a fixedly predetermined zero position. The rotation sensor 15 transmits an output signal in response to the speed of the shaft 3 to a regulating circuit (see FIG. 4) continuously or in predetermined time intervals.

Another rotation sensor 16 which measures the angular position occupied by the eccentric element 7 relative to the side wall 9 is rigidly attached to the side wall 9. The eccentric element 7 is moved together with the carrying tube 6, for example, by means of a hydraulic actuating motor 17. The actuating motor 17 has a hydraulic cylinder 18 whose piston rod 19 is connected with the carrying tube 6 via a pivot joint 20. The hydraulic cylinder 18 is articulated at a fixed component part 21 of the printing machine such, for example, as the side wall 9.

Figure 4:
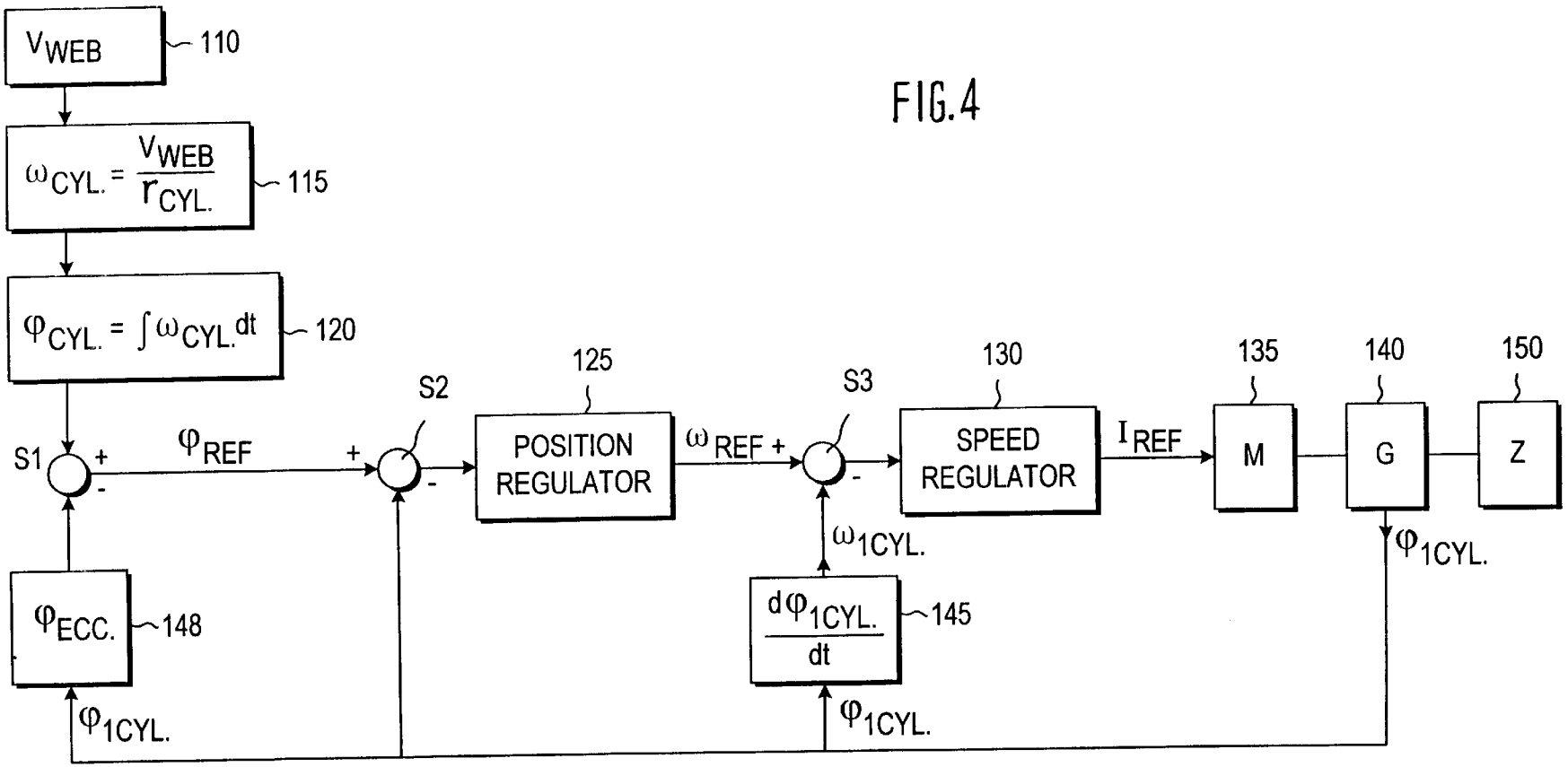
FIG. 4 is a block diagram showing a control circuit for angle correction of a cylinder of the present invention with respect to the fixed parts of the printing machine.

The cylinder 1 may be mounted by one side in the side wall 9, or may be mounted by both side in opposing side walls of the printing machine. In the latter case, it is also mounted in the second side wall via a second eccentric element (not shown). When the cylinder 1 is mounted by only one side wall 9, a supporting wall 22 may be provided in which the carrying tube 6 is mounted via a bearing, for example, a needle bearing 23. When eccentric elements 7 are provided on both sides of the cylinder 1, angle measuring devices such as the rotation sensors 16 may also be arranged on both sides. Both of these angle measurement devices supply the angle values measured by them to the regulating circuit (FIG. 4). The measured angle values can be weighted, for example, in a ratio of 1:1.

Instead of the rotation sensor 16, other means for determining the position of the eccentric element 7 may also be used. For example, an encoder may be to determine the angular position of the eccentric element with respect to the side wall 9. A translational movement of the eccentric element 7 may also be measured, especially when this translational movement is approximately proportional to the rotational angle of the eccentric element 7 in case of small rotational angles. Further, a horizontal and vertical component of the translational movement may also be determined when two position sensors are provided in a corresponding manner for measuring the translational movements. The values of the translational movement are supplied to a computing circuit which determines a respective angle value for the rotational movement of the eccentric element 7.

Instead of the bearing of the cylinder 1 being received in the eccentric element 7, the shaft journal 2 and the electric motor 14 may be received by a rocker swivelably fastened in the side wall 9 and in the opposite side wall. When a rocker is used, a smaller angular error occurs because of the longer lever in comparison with the eccentric element 7; it is therefore possible in this case to approximate the angular movement by a translational movement.

Figure 2A:
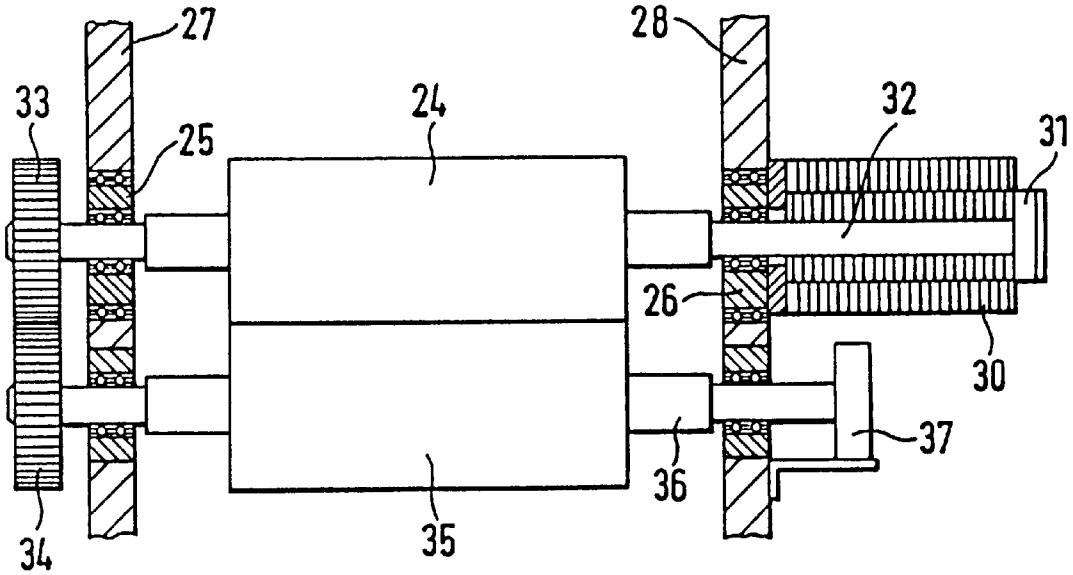
FIG. 2*a* shows a form cylinder and a blanket cylinder configuration with a common drive according to the present invention.
Figure 2B:
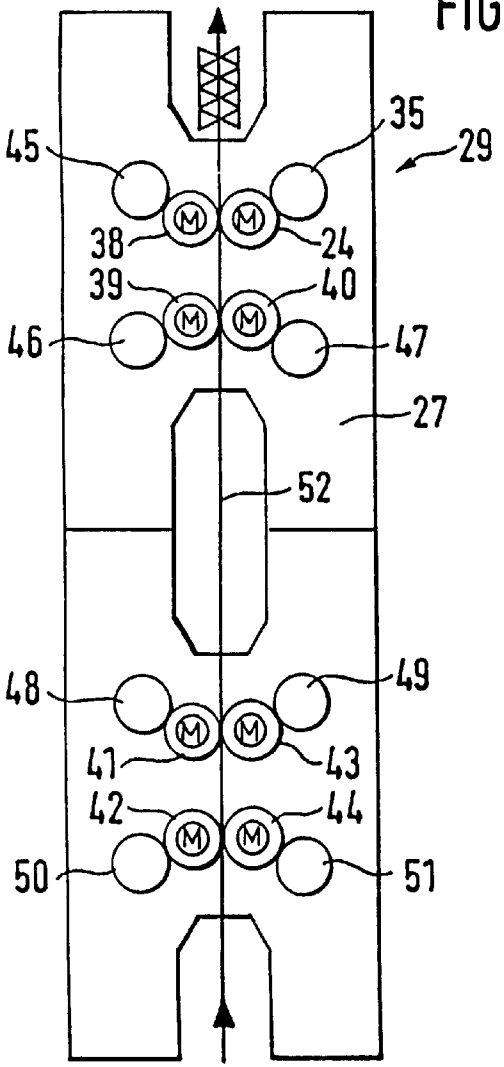
FIG. 2*b* is a side view of a printing mechanism with the form cylinder and blanket cylinder arrangement of FIG. 2*a;*

In another embodiment of the invention shown in FIGS. 2*a* and 2*b*, both sides of a blanket cylinder 24 are mounted at both sides via eccentric elements 25, 26 in side walls 27, 28 of a printing mechanism tower 29. The blanket cylinder 24 is driven directly by an electric motor 30 mounted on the eccentric element 26. An angle encoder 31 arranged at the end side of the electric motor 30 measures the rotational angle of a shaft journal 32 of the blanket cylinder 24 relative to the eccentric element 26. The rotational movement of the blanket cylinder 24 is transmitted by a meshed connection of toothed wheels 33 and 34 to drive a form cylinder 35. An angle encoder 37 arranged on the shaft journal 36 of the form cylinder 35 directly measures the angular position of the form cylinder 35 and also accordingly indirectly measures the angular position of the eccentric element 26 with respect to the rigid side wall 28. The blanket cylinder 24 and the form cylinder 35 cooperate with other blanket cylinders 38 to 44 and form cylinders 45 to 51 to ink both sides of a printing stock web 52 in the printing mechanism tower 29 with four colors on each side. Only the blanket cylinders 24, 38 to 44 are driven by motors. Also, when the eccentric element is adjusted, the drive connection is maintained because the adjustment of the eccentric moves only within the tooth flank clearance of the respective toothed wheels 33, 34.

Figure 3:
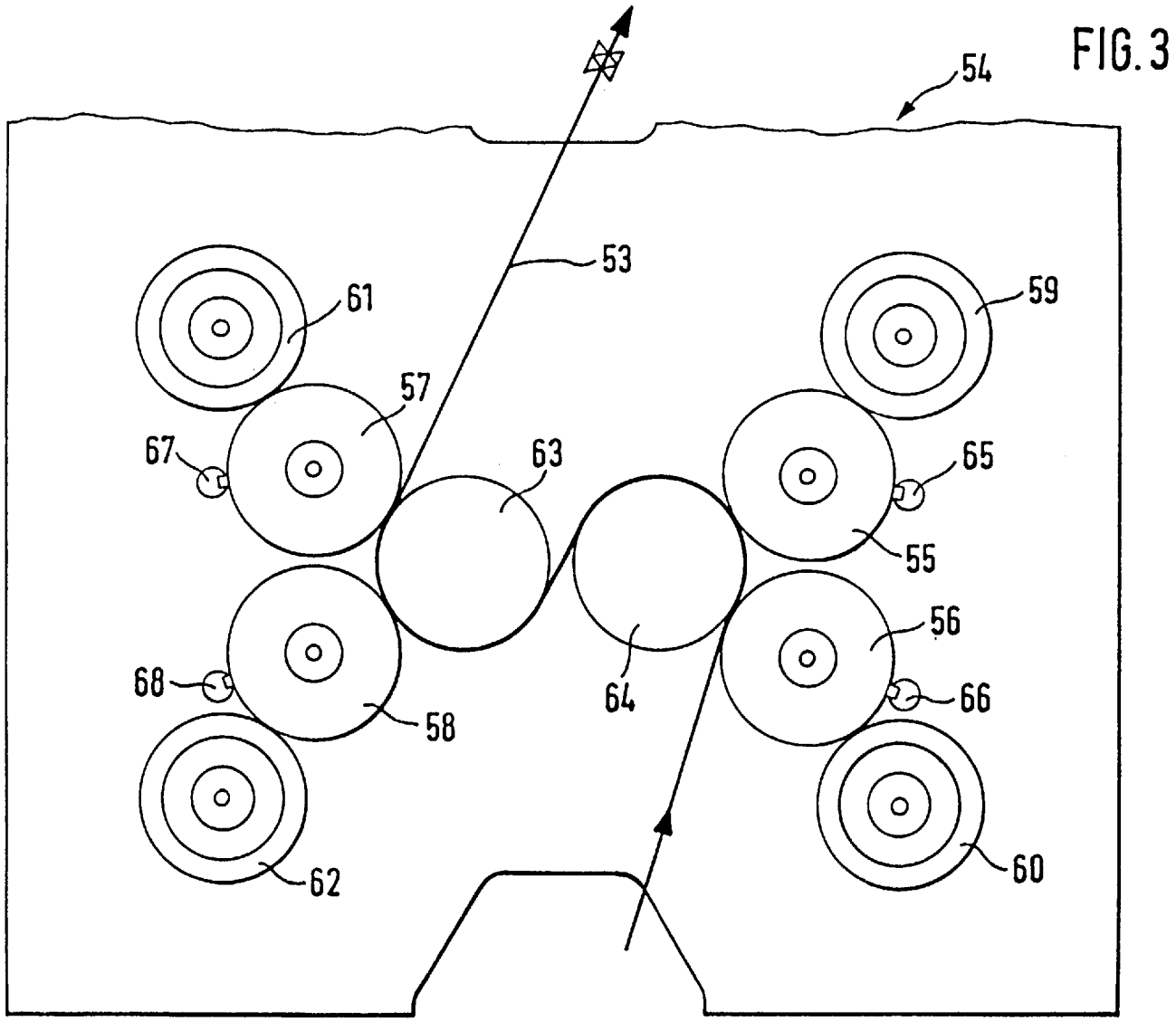
FIG. 3 is a side view of a satellite printing mechanism with individually driven cylinders according to the present invention.

In another embodiment example of the invention shown in FIG. 3, a printing stock web 53 in a satellite printing mechanism 54 is imprinted on both sides by two colors on each side. The satellite printing mechanism 54 comprises four pairs of blanket cylinders 55 to 58 and form cylinders 59 to 62 associated respectively therewith. Also, in this embodiment form, the blanket cylinders 55 to 58 are mounted on eccentrics or rockers (not shown here). The blanket cylinders 55 to 58 are driven directly by electric motors. The form cylinders 59 to 62 and printing cylinders 63, 64 are driven via toothed wheel connections in the same way as is shown in FIG. 2*a* by the electric motors arranged on the shaft journals of the blanket cylinders 55 to 58. Rotation sensors 65 to 68 are fixedly connected at the side wall of the satellite printing mechanism 54 for measuring the angular position of the eccentrics of the blanket cylinders 55 to 58.

To regulate the movement of cylinder 1 of FIG. 1, blanket cylinders 24, 38 to 44 of FIG. 2*a*, and blanket cylinders 55 to 58 of FIG. 3 during an adjustment of the eccentric element so that the cylinders do not slide on the surface of adjacent cylinders, but rather roll continuously on the latter and, in particular, also do not pull on the printing stock web 52, 53 by sliding such that the printing stock web 52, 53 could tear, the movement of the eccentric element is regulated such that the rotation of the eccentric is accompanied by a rolling movement of the cylinder 1 or blanket cylinders 24, 38 to 44, 55 to 58.

Referring now to FIG. 4, a block diagram of a control circuit 100 is shown for determining a rolling movement of a cylinder to accompany the rotation of the eccentric element to prevent the potential for tearing the web. A speedometer 110 determines a web speed of the printing stock web $V_{web}$. The web speed of the printing stock web $V_{web}$ is known under normal circumstances by a preset on the control station of the printing machine and may be input to the speedometer 110 as a constant. However, independent from this known value, the actual web speed may also be determined by a measuring device in the immediate vicinity of the printing mechanism in which the movement of the eccentric element takes place. The speedometer 110 transmits the known or determined web speed $V_{web}$ to a divider 115 which is used to derive a reference angular speed $\omega_{cyl.}$ which is the quotient of the web speed $V_{web}$ and the radius $r_{cyl.}$ of a cylinder Z. By integrating over time in integrator 120, the reference angular speed $\omega_{cyl.}$ gives the reference rotational angle $\phi_{cyl.}$ occupied by the cylinder Z with respect to the machine frame, the printing stock web, for example, printing stock web 52 or 53, and with respect to the other cylinders, for example, the form cylinders 35, 45 to 51 and 59 to 62 or the printing cylinders 63, 64. The reference rotational angle $\phi_{cyl.}$ is transmitted to a first summing point S1 at which the difference in relation to an angle $\phi_{ecc.}$ of the eccentric element E with respect to the machine frame flows into a second summing circuit S2. The angle $\phi_{ecc.}$ is either directly the angle measured by the second rotation sensor, for example, the angle encoder 37, or an angle measured by one of the rotation sensors 65 to 68 relative to the side wall, or an angle derived therefrom. For example, the angle $\phi_{ecc.}$ may also be obtained from the transverse relative movement of the cylinder axle of the eccentrically mounted cylinder, for example, by linearization of the functional relationship between the transverse offset and the associated angle $\phi_{ecc.}$. The angle reference value $\phi_{ref.}$ obtained from the angles $\phi_{cyl.}$ and $\phi_{ecc.}$ is transmitted to a bearing or position regulator 125 in which a reference speed $\omega_{ref}$ is obtained from the reference angle value $\phi_{ref}$. This reference speed $\omega_{ref}$ is transmitted through a third summing circuit S3 to a speed regulator 130. The speed regulator 130 obtains, as regulating variable, a reference current $I_{ref}$ or a reference torque for an electric motor M which corresponds, for example, to electric motor 30 and which drives the cylinder Z from the reference speed $\omega_{ref}$. The rotation sensor or angle encoder 140 of cylinder Z which corresponds to rotation sensor 15 supplies the actual rotational angle $\phi_{1cyl.}$ of the cylinder Z with respect to the eccentric element E, for example, eccentric element 7, or with respect to the motor housing which is connected, for example, with the carrying arm 6. The actual rotational angle $\phi_{1cyl.}$ is transmitted to the input side of the speed regulator 130, for example, via a differential element 145. The differential element 145 obtains the actual angular speed $\omega_{1cyl.}$ from the actual rotational angle $\phi_{1cyl.}$. The actual angular speed $\omega_{1cyl.}$ may also be obtained by subtraction from different actual rotational angle values at different times and dividing by the difference in times. The actual rotational angle $\phi_{1cyl.}$ is also transmitted to the input of the position regulator 125 the second summing point S2. Further, in accordance with an embodiment form of the invention, the actual rotational angle $\phi_{1cyl.}$ may also be utilized to obtain a suitable function from the angle $\phi_{ecc.}$ of the eccentric element E which is supplied to the summing point S1. The adjusting movement of the eccentric element E is accordingly either directly detected as an angular adjustment $\phi_{ecc.}$. auxiliary variable, for example, the setting of a lever acting on the eccentric element E, is transformed into a value corresponding to the angle $\phi_{ecc.}$.

Further, it is also possible that the exact movement sequence of the eccentric element movement is already known beforehand, so that a direct or indirect detection of the angle $\phi_{ecc.}$ of the eccentric element may be dispensed with and the respective angle values from the starting time or ending time of the eccentric movement are stored already in an electronic storage and used for regulating the angular position of the cylinder. The transverse movement executed by the cylinder during adjustment of the eccentric is likewise known by way of the movement sequence of the eccentric and can be compensated by the drive control of the cylinder. Damaging relative movements between the cylinder and the printing stock or with other adjacent cylinders can accordingly be prevented. For example, the translational component of the adjustment of the eccentric can be calculated from the angle $\phi_{ecc.}$ of the eccentric E in a computing circuit and supplied separately to the summing point S1.

However, it is also possible to measure exclusively the translational movement of the eccentric E with an appropriate sensor and to obtain therefrom the respective angle value $\phi_{ecc.}$ in a computing circuit, for example, from an algebraic rule. A filter can be installed to smooth the calculated angle values $\phi_{ecc.}$. The angle values for $\phi_{ecc.}$ may also already be stored in a table so that an angle value $\phi_{ecc.}$ corresponding to the path traveled during a determined translational movement of the eccentric E is supplied from the table to the regulating circuit of FIG. 4.

The adjusting movement between the cylinder and the side wall may be detected indirectly by the rotation sensor of an eccentric element, as was described above, or may be detected directly via a rotation sensor arranged at the cylinder shaft which measures the movement of the cylinder relative to the side wall.

The present invention provides a cylinder 24 having an adjustable position. The cylinder 24 may be adjusted away from a printing stock web or an adjacent cylinder 35 and the change in position caused by a movement of the eccentric is compensated by an additional rotating movement superposed on the rotating movement of the cylinder 24 such that the outer surface of the cylinder 24 has no velocity relative to the adjacent cylinder 35 or to the printing stock web. Compensation is performed by a regulating circuit to which is supplied the actual rotational angle $\phi_{1cyl.}$ of the cylinder 24 with respect to the eccentric 26 and the actual rotational angle $\phi_{ecc.}$ of the eccentric 26 with respect to the side wall 28 or an angular function derived therefrom.

Instead of being driven directly as was described above, the blanket cylinder 24, 38, 39, 40, 41, 42, 43, 44, 55, 56, 57, 58 may be driven indirectly by the form cylinder 35, 45, 46, 47, 48, 49, 50 or 51 which is driven directly.

The invention is not limited by the embodiments described above which are presented as examples only but can be modified in various ways within the scope of protection defined by the appended patent claims.

We claim:

1. A swivelable cylinder assembly for a printing machine having a side wall, comprising:

a swiveling device mountable in the side wall of the printing machine and swivelable about a swivel axis;

a cylinder rotatably mounted on said swiveling device wherein an axis of rotation is remote from said swivel axis such that a position of said cylinder moves when said swiveling device swivels about said swivel axis;

an electric motor drivably connected to said cylinder for rotating said cylinder at a rotational velocity;

a rotation angle measuring device determining an actual rotational angle of said cylinder with respect to said swivel device;

a swivel angle measuring device determining a swivel movement of said swivel device with respect to said side wall;

a controller converting a web speed of the printing machine to an angular web speed value and determining a reference rotational angle of said cylinder from said angular web speed and said swivel movement; and said controller comprising a comparator outputting a control signal in response to a comparison of said reference rotational angle and said actual rotational angle, wherein said controller transmits said control signal to said electric motor for controlling said angular velocity of said cylinder and thereby adjusts the actual rotational angle in response to said swivel movement.

2. The cylinder assembly of claim 1, wherein said comparator comprises a speed regulator in an electronic regulating circuit and said output signal comprises one of a reference current and a reference torque signal.

3. The cylinder assembly of claim 2, wherein said controller further comprises a differential element determining a rotational velocity from said actual rotational angle of said cylinder, and wherein said rotational velocity is transmitted to said speed regulator.

4. The cylinder assembly of claim 2, wherein said controller continuously corrects said actual rotational angle of said cylinder with respect to the swiveling device during a swiveling movement, to compensate for a relative rotation of said cylinder relative to one of a printing web and an adjacent cylinder effected by said swiveling movement, and wherein correction values for said reference rotational angle of said cylinder are one of stored in a table in a memory of said controller and calculated by a computing circuit in said controller.

5. The cylinder assembly of claim 2, wherein said swivel angle measuring device comprises an angle rotation sensor for directly measuring an angle of said swiveling movement relative to the side walls of the printing machine.

6. The cylinder assembly of claim 2, wherein said swivel angle measuring device measures a translational adjustment path of the swiveling device and derives an angular position of the swiveling device using one of a computing circuit and a table stored in a memory of said controller.

7. The cylinder assembly of claim 2, wherein said reference rotational angle of said cylinder is continuously derived from a known movement sequence of the swiveling device.

8. The cylinder assembly of claim 1, wherein said swiveling device comprises one of an eccentric element and a rocker type device.

9. The cylinder assembly of claim 1, wherein said swivel angle measuring device comprises one of a rotation sensor and an encoder.

10. The cylinder assembly of claim 1, wherein said swivel angle measuring device directly measures the rotation of said swiveling device with respect to a rigid part of the printing machine.

11. The cylinder assembly of claim 1, wherein said swivel angle measuring device detects said swiveling movement indirectly based on the rotational movement of an adjacent cylinder having a first toothed wheel in meshed engagement with a second toothed wheel on said cylinder.

* * * * *